US006913503B2

(12) United States Patent
Nishida et al.

(10) Patent No.: US 6,913,503 B2
(45) Date of Patent: Jul. 5, 2005

(54) HIGH PRESSURE DISCHARGE LAMP AND METHOD OF PRODUCTION THEREFOR

(75) Inventors: Kazuhisa Nishida, Tokyo (JP); Toshimoto Makino, Tokyo (JP)

(73) Assignee: NEC Microwave Tube, Ltd., Kanagawa-ken (JP)

( * ) Notice: Subject to any disclaimer, the term of this patent is extended or adjusted under 35 U.S.C. 154(b) by 146 days.

(21) Appl. No.: 10/443,873

(22) Filed: May 23, 2003

(65) Prior Publication Data

US 2003/0203701 A1 Oct. 30, 2003

Related U.S. Application Data

(62) Division of application No. 09/897,987, filed on Jul. 5, 2001, now Pat. No. 6,608,440.

(30) Foreign Application Priority Data

Jul. 4, 2000 (JP) ..... 2000-202663

(51) Int. Cl.[7] ..... H01J 9/00; H01J 17/20; H01J 61/12

(52) U.S. Cl. ..... 445/26; 445/38; 313/568; 313/579

(58) Field of Search ..... 445/26, 38, 40, 445/43, 17; 313/568, 579, 571, 574, 631, 637, 639, 641

(56) References Cited

U.S. PATENT DOCUMENTS 5,109,181 A 4/1992 Fischer et al.
6,211,616 B1 4/2001 Takeuti et al.
6,271,628 B1 * 8/2001 Sugitani et al. ..... 313/637
6,483,240 B2 * 11/2002 O'Hare et al. ..... 313/633
6,669,522 B2 * 12/2003 Nishida ..... 445/26

FOREIGN PATENT DOCUMENTS

| | | | |
|---|---|---|---|
| EP | 0 917 180 A1 | 5/1999 | |
| EP | 0 944 109 A1 | 9/1999 | |
| GB | 2 064 211 A | 6/1981 | |
| JP | A 2-148561 | 6/1990 | |
| JP | A 3-219548 | 9/1991 | |
| JP | 2 829 339 | 9/1998 | |
| JP | A 10-312751 | 11/1998 | |
| JP | 11-149899 | 6/1999 | |
| JP | 2 980 882 | 9/1999 | |
| JP | 11-297268 | 10/1999 | |
| JP | 11-297274 | 10/1999 | |
| JP | 11-329350 | 11/1999 | |
| JP | 2001118538 A * | 4/2001 | ..... H01J/61/06 |

* cited by examiner

*Primary Examiner*—Karabi Guharay
(74) *Attorney, Agent, or Firm*—Young & Thompson

(57) ABSTRACT

A high pressure discharge lamp includes a quartz glass bulb and a pair of electrodes. Each electrode of the pair of electrodes is disposed so as to be opposite the other in the quartz glass bulb. The quartz glass bulb of the high pressure discharge lamp contains at least mercury and a halogen gas which are airtightly sealed in the quartz glass bulb. The partial pressure of oxygen (O) in the quartz glass bulb is about $2.5\times10^{-3}$ Pa or less and the partial pressure of the halogen gas in the quartz glass bulb is in the range between about $1\times10^{-6}$ $\mu$mol/mm$^3$ and $1\times10^{-8}$ $\mu$mol/mm$^3$. The pair of electrodes contain potassium oxide in the range between about 20 ppm and 40 ppm.

13 Claims, 3 Drawing Sheets

HIGH PRESSURE DISCHARGE LAMP AND METHOD OF PRODUCTION THEREFOR

This application is a division of Application Ser. No. 09/897,987, filed on Jul. 5, 2001, now U.S. Pat. No. 6,608, 440, the entire contents of which are hereby incorporated by reference.

BACKGROUND OF THE INVENTION

1. Field of the Invention

The present invention relates to a high pressure discharge lamp and to a method for producing the high pressure discharge lamp. More specifically, the present invention relates to a long-life high pressure discharge lamp which, even after being used for a long period of time, has a low degree of blackening and decrease in luminance, and which is capable of preventing leakage of a contained gas and blowout of the bulb, and to a method for manufacturing such a high pressure discharge lamp.

2. Description of Related Art

In general, a high pressure discharge lamp has a structure, for instance, as shown in FIG. 4. In the high pressure discharge lamp 110 shown in FIG. 4, each electrode of a pair of electrodes 102 and 102 made of tungsten is disposed so as to be opposite the other in a quartz glass bulb 101, which includes a round-shaped central portion. Each of these electrodes 102 and 102 is inserted from a respective insertion opening 104 located at an end of the bulb 101 and each of the insertion openings 104 is airtightly sealed with the respective electrode 102 via a sleeve-shaped molybdenum foil 105 which is a thermal cushioning material. A halogen gas, such as mercury gas or methylene bromide gas, and an inert gas, such as argon, are contained and sealed in the bulb 101.

In general, a relatively large amount of mercury, for instance, in an amount of more than 0.15 mg/mm$^3$, is contained in the high pressure discharge lamp 110. When the lamp 110 is lit and a trigger voltage is applied to the electrodes 102 and 102, a glow discharge is induced between the electrodes under the atmosphere of the above-mentioned inert gas and the contained mercury is vaporized to emit light of high luminance and excellent color rendering property due to a plasma discharge by the high-pressure mercury vapor. Since light of high luminance and excellent color rendering property is obtained by using the high pressure discharge lamp as explained above, the lamp has recently attracted attention as a light source for devices such as a projection type liquid crystal display and is used for a variety of purposes.

During the initial phase of using the high pressure discharge lamp, problems associated with the use thereof were pointed out, such as blackening of the inner surface of the bulb and reduction in the luminance of the lamp after it has been lit for a considerably long period of time. These problems are attributed to the fact that, as shown in FIG. 4, tungsten atoms or molecules W are vaporized by the discharge which occurs at high temperatures and they are deposited onto the inner surfaces of the bulb 101. Accordingly, in order to prevent the generation of blackening, a halogen gas is used and is sealed in the bulb 101. The halogen gas produces halogen ions at high temperatures which bond to and vaporize the tungsten deposited onto the inner surface of the bulb 101 and redeposit the tungsten onto a base portion of the electrode at which the temperature is relatively low. This is a so-called "halogen cycle" and this cycle is repeated so that the generation of blackening of the bulb may be prevented.

A halogen compound, such as methylene bromide, is generally used as the above-mentioned halogen gas. The halogen compound, when the lamp is lit, is decomposed in the bulb 101 and generates halogen ions. In general, the halogen gas is contained so that the partial pressure of the halogen gas in the bulb 101 becomes $1\times10^{-6}$ $\mu$mol/mm$^3$ or greater which is considered to be an amount effective for preventing the generation of blackening.

Also, an inert gas, such as argon, is contained in the bulb 101 in an amount in the range between about $6\times10^3$ Pa and $6\times10^4$ Pa in order to induce a glow discharge at the start of lighting the lamp 110.

However, although a halogen gas is contained in the bulb 101 in order to prevent a decrease in the luminance of the lamp 110 due to the generation of blackening as mentioned above, the halogen gas, when present in excessive, tends to erode and deteriorate the electrodes 102 and molybdenum foils 105 at the sealing portions of the bulb 101. If the erosion proceeds, a contained gas may leak from the sealing portions or a blowout of the bulb 101 may be caused since the pressure inside the bulb 101 exceeds 100 atmospheres due to the vapor pressure of the contained mercury. For this reason, studies have been conducted to achieve an overall improvement of the high pressure discharge lamp, the improvement including the structure thereof and an amount of various components contained in the bulb 101 in order to prevent problems such as the generation of blackening, leaking of contained gases and blowout of the bulb 101.

For example, Japanese Unexamined Patent Application, First Publication No. 11-149899 discloses an amount of mercury contained between 0.12 and 0.35 mg/mm$^3$, an amount of a halogen gas between $10^{-7}$ and $10^{-2}$ $\mu$mol/mm$^3$, and an amount of potassium oxide contained in an electrode of 12 ppm or less (5 ppm or less in the embodiments). In this publication, it is concluded that the lower the amount of potassium oxide contained in the tungsten electrode, the greater the effect of preventing the generation of blackening of the bulb.

Japanese Patent No. 2829339 discloses a high pressure discharge lamp in which an amount of mercury contained is between 0.2 and 0.35 mg/mm$^3$, and an amount of a halogen gas is between $10^{-6}$ and $10^{-4}$ $\mu$mol/mm$^3$.

Japanese Patent No. 2980882 discloses an amount of mercury of 0.16 mg/mm$^3$ or more, an amount of halogen gas between $2\times10^{-4}$ and $7\times10^{-3}$ $\mu$mol/mm$^3$, and, preferably, a bulb wall loading of 0.8 W/mm$^2$ or more and an amount of an inert gas of $5\times10^3$ Pa or more.

Japanese Unexamined Patent Application, First Publication No. 11-297274 discloses an amount of mercury which reaches between 100 and 200 atmospheres when a lamp is lit, and an amount of a halogen gas between $1.1\times10^{-5}$ and $1.2\times1^{-7}$ mol/cc.

Also, Japanese Unexamined Patent Application, First Publication No. 11-329350 discloses a discharge lamp filled with a noble gas, the ratio of the maximum intensity of the emission spectrum of hydrogen, oxygen and their compounds which are present in a light emitting part to the intensity of the main emission spectrum of the noble gas being 1/1,000 or less, and the content of the hydroxyl group in the quartz glass of sealing parts being 5 ppm or less by weight.

However, no matter how the amount of components contained in the bulb of the high pressure discharge lamp is adjusted as described in the above-mentioned documents, problems of the decrease in the luminance of the lamp due to the generation of blackening, leakage of contained gas, and blowout of the bulb cannot be solved by any single means simultaneously.

SUMMARY OF THE INVENTION

Accordingly, an object of the present invention is to provide a high pressure discharge lamp in which the above-mentioned problems have been solved and a method for producing such a high pressure discharge lamp.

Another object of the present invention is to provide a long-life high pressure discharge lamp which, even after being used for a long time, has a low degree of blackening or decrease in luminance and is capable of preventing leakage of the contained gas or a blowout of the bulb, and a method for manufacturing such a high pressure discharge lamp.

The inventors of the present invention, after pursuing diligent research to achieve the above-mentioned objects, discovered that although gas in a bulb is evacuated to a degree of about $1\times10^{-1}$ Pa by using a means such as a vacuum pump in advance of the introduction of various components to be contained in a conventional high pressure discharge lamp, oxygen components such as oxygen gas or carbon dioxide still remain in the bulb to some extent, and these oxygen components inhibit the above-mentioned halogen cycle when the lamp is lit. It was observed that an excessive amount of a halogen gas must be contained in the bulbs of the conventional high pressure discharge lamps for the reason explained above, and this shortens the life of the high pressure discharge lamps. It was also discovered that tungsten molecules vaporized by the discharge under high temperature are ionized and damage the electrode by sputtering the electrode itself, thereby causing a leaking of gas or a blowout of the bulb.

The inventors of the present invention, after pursuing diligent research to find out conditions for extending the service life of the high pressure discharge lamp, have discovered that the amount of the above-mentioned oxygen components, the amount of halogen gas contained in the bulb, and the amount of potassium oxide contained in the tungsten electrode are closely related to the extension of the service life of the high pressure discharge lamp, and that by optimizing the amount of the above-mentioned three factors, it becomes possible to prevent problems such as the generation of blackening, leaking of contained gases, and blowout of the bulb, and to obtain a high pressure discharge lamp with a long service life.

Accordingly, the present invention provides a high pressure discharge lamp including a quartz glass bulb and a pair of electrodes, each electrode of the pair of electrodes being disposed so as to be opposite the other in the quartz glass bulb, wherein at least mercury and a halogen gas are airtightly sealed in the quartz glass bulb, and the partial pressure of oxygen (O) in the quartz glass bulb is about $2.5\times10^{-3}$ Pa or less, the partial pressure of the halogen gas in the quartz glass bulb is in the range between about $1\times10^{-6}$ $\mu$mol/mm$^3$ and $1\times10^{-8}$ $\mu$mol/mm$^3$, and the pair of electrodes contain potassium oxide in the range between about 20 ppm and 40 ppm.

In the high pressure discharge lamp according to an embodiment of the present invention mentioned above, a decrease in the luminance due to the generation of blackening of the bulb, and leakage of a contained gas or blowout of a bulb may be prevented even after the bulb is lit for a considerably long period of time, and it becomes possible to obtain a long-life high pressure discharge lamp. The reason for this has not been completely clarified, but it is believed that the inhibition of the halogen cycle by the remaining oxygen is minimized since the partial pressure of oxygen in the lamp is restricted to about $2.5\times10^{-3}$ Pa or less. Therefore, according to the present invention, the halogen cycle may proceed smoothly using a smaller amount of halogen gas as compared with that in a conventional bulb, and the damage to the tungsten electrodes due to sputtering may be prevented since an appropriate amount of potassium oxide is contained in the tungsten electrodes under the low oxygen and low halogen gas atmosphere.

In a conventional process for producing a discharge lamp, on the other hand, although air in a bulb is temporarily evacuated to some extent in advance of the introduction of a halogen gas or an inert gas, the vacuum is not carried out to a degree at which the level of the oxygen partial pressure becomes $2.5\times10^{-3}$ Pa or less since it was not known until recently that the presence of oxygen inhibits the halogen cycle. Accordingly, a relatively large amount of halogen gas has been used to prevent the generation of blackening, and it has been considered that the presence of potassium oxide in the tungsten electrodes induces and enhances the generation of blackening.

In addition, it was discovered by the inventors of the present invention that the remaining oxygen in the bulb decreases the production efficiency of mercury plasma and reduces initial luminance of the discharge lamp. Accordingly, the initial luminance of the discharge lamp can be improved and the time required for lighting the lamp (or the induction period of the lamp) may be shortened by restricting the partial pressure of oxygen to about $2.5\times10^{-3}$ Pa or less. In this manner, a high pressure discharge lamp which is capable of quickly reaching its stable state of luminance and maintaining the luminance for a considerably long period of time may be obtained by an embodiment of the method according to the present invention.

In this specification, the term "partial pressure of oxygen (O)" means the total of partial pressure of oxygen-containing gases, such as $O_2$, CO, $CO_2$, and $H_2O$. The partial pressure of oxygen may be measured by taking a sample of the gas contained in a manufactured high pressure discharge lamp, and analyzing the sample using any suitable means.

In accordance with another aspect of the invention, it is preferable that the amount of mercury contained in the quartz glass bulb be about 0.15 mg/mm$^3$ or greater with respect to the volume of the quartz glass bulb.

The mercury contained in the bulb is vaporized by a glow discharge in the bulb and emits light of high luminance and excellent color rendering property due to a plasma discharge by the high-pressure mercury vapor. Such light of high luminance cannot be obtained if the amount of mercury contained in the quartz glass bulb is less than 0.15 mg/mm$^3$ due to insufficient gas pressure.

In yet another aspect of the invention, it is preferable that the halogen gas contain at least one of bromine, chlorine, and iodine. A halogen gas containing bromine, chlorine, or iodine can realize a smooth halogen cycle.

In yet another aspect of the invention, it is preferable that the high pressure discharge lamp further include an inert gas which is sealed in the quartz glass bulb, and that the amount of the inert gas in the quartz glass bulb be in the range between about $6\times10^3$ Pa and $6\times10^4$ Pa.

The inert gas used in the above high pressure discharge lamp may be helium, argon, neon, or nitrogen. These inert gases are useful as a glow-starter for the glow discharge which vaporizes mercury.

In yet another aspect of the invention, it is preferable that the quartz glass bulb have insertion openings through which the pair of electrodes are inserted into the quartz glass bulb, and that the insertion openings be airtightly sealed with the pair of electrodes via a conductive element.

In yet another aspect of the invention, it is preferable that the conductive element be molybdenum foil.

According to the above high pressure discharge lamp, since an evacuation process of the quartz glass bulb or an introduction of gases to the bulb may be carried out by using at least one of the insertion openings through which one of the electrodes is inserted, it is not necessary to form another opening for carrying out the evacuation process or the introduction process. On the other hand, the conductive element or molybdenum foil having a sleeve-shape is present between the insertion opening of the quartz glass bulb and the electrode so as to airtightly seal the insertion opening with the electrode and to generate a thermal cushioning effect for the heat cycle of the high pressure discharge lamp.

In yet another aspect of the invention, it is preferable that the bulb wall loading of the quartz glass bulb be in the range between about 0.8 $W/mm^2$ and 2.0 $W/mm^2$.

If the bulb wall loading of the quartz glass bulb is outside of the above-mentioned range, the luminous efficacy (lumen/W) of the lamp will be reduced.

The present invention also provides a method for manufacturing a high pressure discharge lamp including a quartz glass bulb; a pair of electrodes, each electrode of the pair of electrodes being disposed so as to be opposite the other in the quartz glass bulb and containing potassium oxide in the range between about 20 ppm and 40 ppm; and at least mercury, a halogen gas, and an inert gas contained and sealed in the quartz glass bulb, comprising the steps of: carrying out an evacuation process in which the quartz glass bulb is evacuated so that the partial pressure of oxygen (O) in the quartz glass bulb is about $2.5\times10^{-3}$ Pa or less; carrying out a mercury sealing process in which the mercury is sealed in the quartz glass bulb so that the amount of the mercury with respect to the space volume in the quartz glass bulb becomes about 0.15 $mg/mm^3$ or greater; carrying out a halogen gas introduction process in which the halogen gas is introduced into the quartz glass bulb so that the partial pressure of the halogen gas in the quartz glass bulb falls in the range between about $1\times10^{-6}$ $\mu mol/mm^3$ and $1\times10^{-8}$ $\mu mol/mm^3$; and carrying out an inert gas introduction process in which the inert gas is introduced into the quartz glass bulb so that the partial pressure of the inert gas in the quartz glass bulb falls in the range between about $6\times10^3$ Pa and $6\times10^4$ Pa.

According to the above method, the above-mentioned high pressure discharge lamps of the present invention can be produced. The order of introduction of mercury, the halogen gas, and the inert gas is not particularly limited and may be changed. Also, two or more of these may be premixed and may be introduced into the quartz glass bulb at the same time, i.e., two or more of the above-mentioned processes can be carried out at the same time.

In yet another aspect of the invention, the evacuation process of the above method for manufacturing a high pressure discharge lamp is carried out after one of the pair of electrodes is inserted into a first insertion opening formed in the quartz glass bulb and is airtightly sealed with the first insertion opening so that the quartz glass bulb may be evacuated through a second insertion opening formed in the quartz glass bulb; the halogen gas introduction process is carried out, after the evacuation process, by introducing the halogen gas into the quartz glass bulb through the second insertion opening; the inert gas introduction process is carried out, after the evacuation process, by introducing the inert gas into the quartz glass bulb through the second insertion opening; and the second insertion opening is airtightly sealed with the other one of the pair of electrodes after carrying out the mercury sealing process, the halogen gas introduction process, and the inert gas introduction process.

According to the above high pressure discharge lamp, since the evacuation process of the quartz glass bulb, the mercury sealing process, the halogen gas introduction process, and the inert gas introduction process may be carried out after one of the electrodes is inserted into one of the insertion openings by using the remaining insertion opening, and then the other one of the electrodes may be inserted into the remaining opening, it is not necessary to form another opening especially designed for carrying out the evacuation process. Also, no special labor is required for the evacuation process. Moreover, the evacuation process may be performed by using conventional devices, such as a combination of a diffusion pump and a vacuum pump.

In yet another aspect of the invention, the method for manufacturing a high pressure discharge lamp further including the steps of: carrying out a first electrode assembling process in which one of the pair of electrodes is inserted into a first insertion opening formed in the quartz glass bulb, and then the first insertion opening is airtightly sealed; and carrying out a second electrode assembling process in which the other one of the pair of electrodes is inserted into a second insertion opening formed in the quartz glass bulb, and then the second insertion opening is airtightly sealed, wherein oxygen present in the quartz glass bulb is evacuated from the second insertion opening in the evacuation process after the first electrode assembling process and before the second electrode assembling process; and the halogen gas is introduced into the quartz glass bulb through the second insertion opening in the halogen gas introduction process after the evacuation process.

According to the above method, since the evacuation process may be carried out using the second insertion opening after the first insertion opening is sealed with one of the electrodes, and then the second insertion opening is sealed with the other one of the electrodes, it is not necessary to form another opening specially designed for the evacuation process and no troublesome operation is required. Also, the halogen gas may be introduced to the quartz glass bulb by using the same insertion opening. The evacuation process may be performed by using any known device, such as a combination of a diffusion pump and a vacuum pump.

In yet another aspect of the invention, mercury is introduced into the quartz glass bulb from the second insertion opening in addition to the halogen gas in the introduction process.

In yet another aspect of the invention, an inert gas is introduced into the quartz glass bulb from the second insertion opening in addition to the halogen gas and mercury in the introduction process.

That is, after performing the evacuation process, mercury and the halogen gas and preferably, the inert gas, are introduced to the quartz glass bulb through the same insertion opening used for the evacuation process, and then the insertion opening is sealed with the electrode. The order of introduction of mercury, the halogen gas, and the inert gas may be interchanged. Also, two or more of these may be premixed and may be introduced into the quartz glass bulb at the same time.

The present invention also provides a method for manufacturing a high pressure discharge lamp including a quartz glass bulb; a pair of electrodes, each electrode of the pair of electrodes being disposed so as to be opposite the other in the quartz glass bulb and containing potassium oxide in the range between about 20 ppm and 40 ppm; and at least mercury, a halogen gas, and an inert gas contained and sealed in the quartz glass bulb, comprising the steps of: carrying out an evacuation process in which the quartz glass bulb is evacuated so that the partial pressure of oxygen (O) in the quartz glass bulb becomes about $2.5\times10^{-3}$ Pa or less; carrying out a mercury sealing process in which the mercury is sealed in the quartz glass bulb so that the amount of the mercury with respect to the space volume in the quartz glass bulb becomes about 0.15 $mg/mm^3$ or greater; carrying out a halogen gas introduction process in which the halogen gas is introduced into the quartz glass bulb so that the partial pressure of the halogen gas in the quartz glass bulb falls in the range between about $1\times10^{-6}$ $\mu mol/mm^3$ and $1\times10^{-8}$ $\mu mol/mm^3$; and carrying out an inert gas introduction process in which the inert gas is introduced into the quartz glass bulb so that the partial pressure of the inert gas in the quartz glass bulb falls in the range between about $6\times10^3$ Pa and $6\times10^4$ Pa, wherein the evacuation process is carried out after one of the pair of electrodes is inserted into a first insertion opening formed in the quartz glass bulb and is airtightly sealed with the first insertion opening so that the quartz glass bulb may be evacuated through a second insertion opening formed in the quartz glass bulb; the halogen gas introduction process is carried out, after the evacuation process, by introducing the halogen gas into the quartz glass bulb through the second insertion opening; the inert gas introduction process is carried out, after the evacuation process, by introducing the inert gas into the quartz glass bulb through the second insertion opening; and the second insertion opening is airtightly sealed with the other one of the pair of electrodes after carrying out the mercury sealing process, the halogen gas introduction process, and the inert gas introduction process.

The order of introduction of mercury, the halogen gas, and the inert gas may be changed. Also, two or more of these may be premixed and may be introduced into the quartz glass bulb at the same time.

In yet another aspect of the invention, the first and second insertion openings are airtightly sealed with the pair of electrodes via a conductive element.

In yet another aspect of the invention, it is preferable that the conductive element be molybdenum foil.

In yet another aspect of the invention, it is preferable that the above method for manufacturing a high pressure discharge lamp further include a step of: preheating the quartz glass bulb and members that form the electrodes to a temperature in the range between about 1,000° C. and 2,000° C. in a vacuum. The members that form the electrodes may include, other than the electrodes per se, the above-mentioned conductive element or molybdenum foil.

In yet another aspect of the invention, it is preferable that the first insertion opening and one of the pair of electrodes which is to be inserted into the first insertion opening be heated to a temperature in the range between about 1,000° C. and 2,000° C. in a vacuum when the electrode is airtightly sealed with the first insertion opening, and the second insertion opening and the other one of the pair of electrodes which is to be inserted into the second insertion opening be heated to a temperature in the range between about 1,000° C. and 2,000° C. in a vacuum when the electrode is airtightly sealed with the second insertion opening.

In yet another aspect of the invention, it is preferable that the first insertion opening and one of the pair of electrodes be heated to a temperature in the range between about 1,000° C. and 2,000° C. in a vacuum in the first electrode assembling process, and the second insertion opening and the other one of the pair of electrodes be heated to a temperature in the range between about 1,000° C. and 2,000° C. in a vacuum in the second electrode assembling process.

According to the above method, when the molybdenum foil is present between the electrode and the bulb, high airtightness of the high pressure discharge lamp may be maintained even for a repeated heat cycle. Also, if the quartz glass bulb and members that form the electrodes are preheated to a temperature in the range between about 1,000° C. and 2,000° C. in a vacuum, impurities which inhibit the halogen cycle, such as $O_2$, CO, $CO_2$, and $H_2O$, that are initially absorbed or contained in the quartz glass bulb and members that form the electrodes may be removed, and hence, it becomes possible to further extend the service life of the high pressure discharge lamp according to an embodiment of the present invention. Moreover, if the insertion opening and the corresponding electrode are heated to a temperature in the range between about 1,000° C. and 2,000° C. in a vacuum when they are sealed, impurities in the atmosphere which inhibit the halogen cycle, such as $O_2$, CO, $CO_2$, and $H_2O$, that are absorbed or contained in the insertion openings of the quartz glass bulb and the part of the electrodes the makes contact with the insertion openings may be removed, and hence, it becomes possible to further extend the service life of the high pressure discharge lamp according to an embodiment of the present invention.

BRIEF DESCRIPTION OF THE DRAWINGS

Some of the features and advantages of the invention have been described, and others will become apparent from the detailed description which follows and from the accompanying drawings, in which.

DETAILED DESCRIPTION OF THE INVENTION

The invention summarized above and defined by the enumerated claims may be better understood by referring to the following detailed description, which should be read with reference to the accompanying drawings. This detailed description of a particular preferred embodiment, set out below to enable one to build and use one particular implementation of the invention, is not intended to limit the enumerated claims, but to serve as a particular example of the invention.

Figure 1:
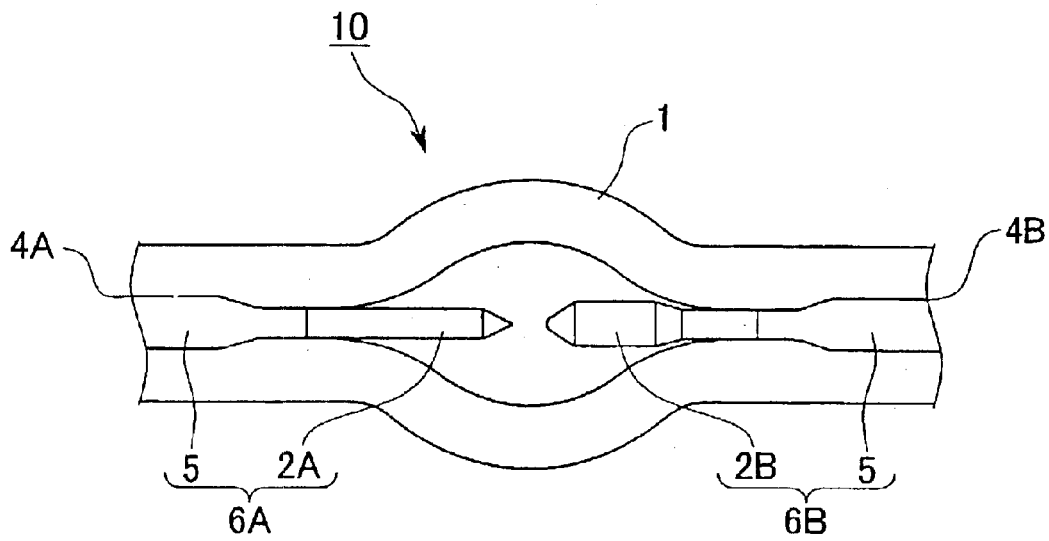
FIG. 1 is a diagram showing a schematic cross-sectional view of a high pressure discharge lamp according to an embodiment of the present invention.

FIG. 1 is a diagram showing a schematic cross-sectional view of a high pressure discharge lamp 10 according to an embodiment of the present invention. In FIG. 1, the high pressure discharge lamp 10 includes a quartz glass bulb 1, a pair of electrodes 2A and 2B made of tungsten, and molybdenum foils 5. The quartz glass bulb 1 has a round-shaped central portion and insertion openings 4A and 4B. The quartz glass bulb 1 may be formed by inserting the pair of electrodes 2A and 2B in the insertion openings 4A and 4B so as to be opposed to each other. The high pressure discharge lamp 10 shown in FIG. 1 is a DC high pressure discharge lamp, and hence, the shape of the electrode 2A is different from that of the electrode 2B. The shapes of the electrodes 2A and 2B, however, can be the same for a case where the high pressure discharge lamp 10 is an AC high pressure discharge lamp, and in this embodiment the discharge lamp 10 can be a DC type or an AC type.

Each of these electrodes 2A and 2B is inserted from a respective insertion opening 4A or 4B located at an end of the bulb 1 and each of the insertion openings 4A and 4B is airtightly sealed with the respective electrode 2A or 2*b* via a sleeve-shaped molybdenum foil 5 which is a thermal cushioning material.

In the high pressure discharge lamp 10 according to this embodiment of the invention, the inside of the airtightly sealed bulb 1 is evacuated and mercury, a halogen gas and an inert gas are introduced. Also, potassium oxide is contained in the tungsten electrodes 2A and 2B.

Figure 2:
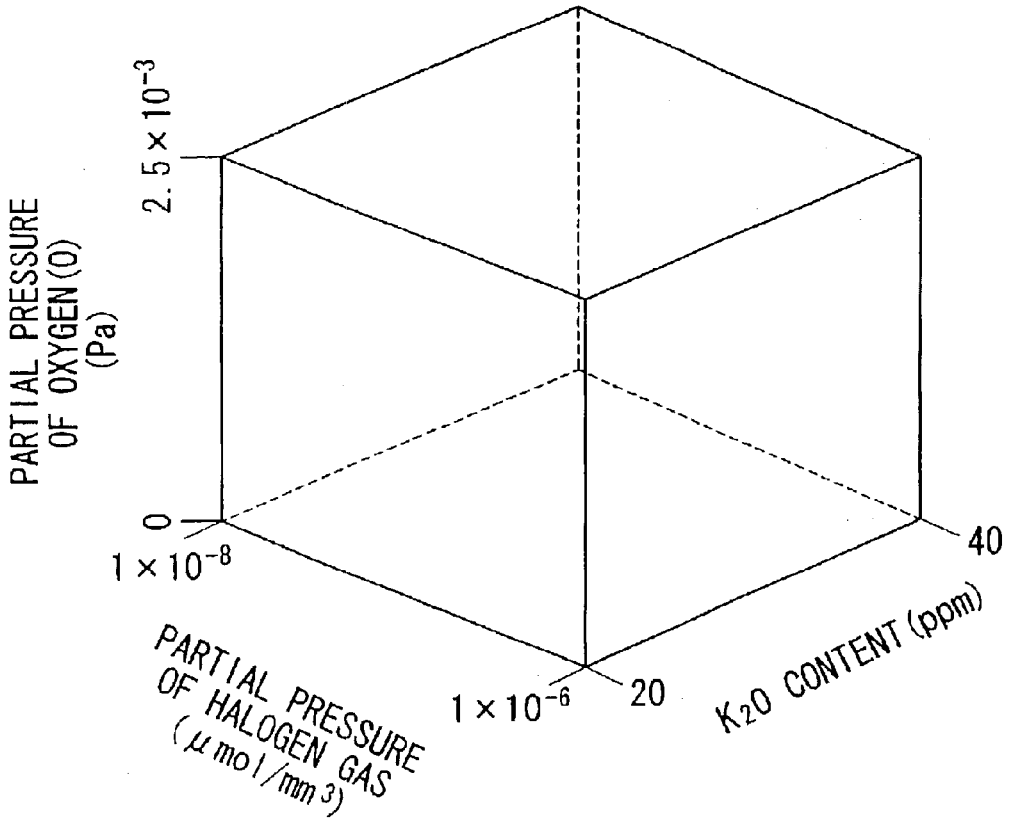
FIG. 2 is a graph showing the partial pressure of oxygen (O), the partial pressure of halogen gas, and the amount of potassium oxide contained in electrodes in accordance with the present invention.

As shown in FIG. 2, in the high pressure discharge lamp 10, the partial pressure of oxygen (O) in the bulb 1, the partial pressure of halogen gas, and the amount of potassium oxide contained in the electrodes 2A and 2B are maintained to be within the predetermined range. That is, the partial pressure of oxygen (O) is about $2.5\times10^{-3}$ Pa or less, the partial pressure of halogen gas (methylene bromide) is in the range between about $1\times10^{-8}$ $\mu$mol/mm$^3$ and $1\times10^{-6}$ $\mu$mol/mm$^3$, and the amount of potassium oxide is in the range between about 20 ppm and 40 ppm.

As will be described in detail in the following, the high pressure discharge lamp 10 according to the embodiment of the present invention, even after being used for a long time, has a low degree of blackening or decrease in luminance and is capable of preventing leakage of a contained gas or a blowout of a bulb due to the partial pressure of oxygen (O) in the lamp 1, the partial pressure of halogen gas, and the amount of potassium oxide contained in the electrodes 2A and 2B defined above.

In this embodiment, the amount of mercury contained in the bulb 1 is 0.15 mg/mm$^3$ or more with respect to the space volume in the bulb 1. Also, the inert gas used in the embodiment is argon gas and the partial pressure of the argon gas is defined to be in the range between about $6\times10^3$ Pa and $6\times10^4$ Pa. Since the high pressure discharge lamp contains 0.15 mg/mm$^3$ or more of mercury, it emits light of high luminance and excellent color rendering property due to a plasma discharge by the high-pressure mercury vapor. The argon gas having the partial pressure of the above-mentioned range induces a glow discharge at the start of lighting the lamp and mercury is vaporized.

When the high pressure discharge lamp 10 is lit and a trigger voltage is applied to the electrodes 2A and 2B, a glow discharge is induced between the electrodes 2A and 2B under the atmosphere of the above-mentioned inert gas and the sealed mercury is vaporized to emit light of high luminance and excellent color rendering property due to a plasma discharge by the high pressure mercury vapor. It was observed that leakage of contained gases or a blowout of the bulb did not occur and blackening of the bulb was not generated even after the high pressure discharge lamp 10 was lit for a considerably long period of time, and the lamp 10 maintained the initial luminance.

Figure 3:
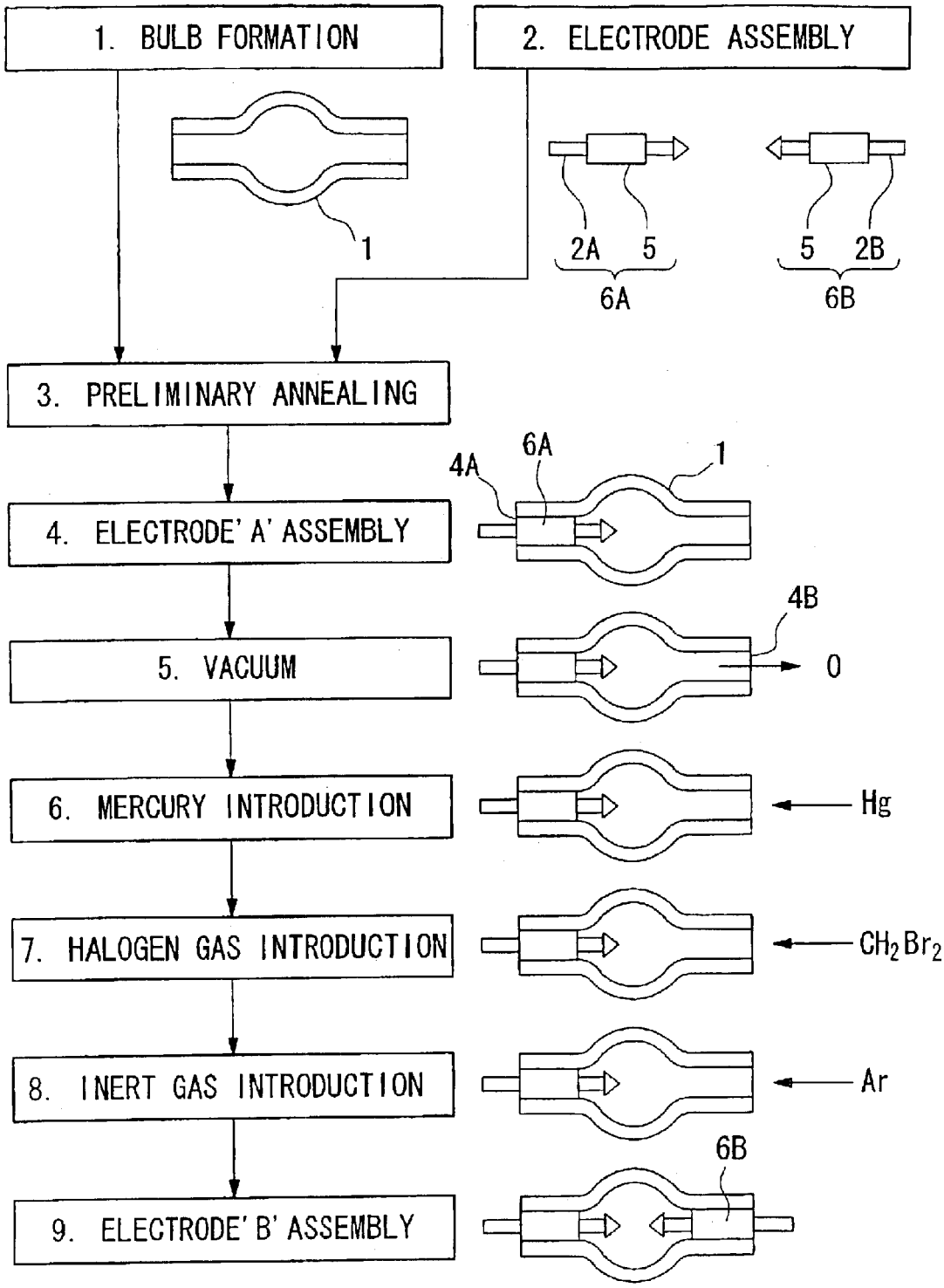
FIG. 3 is a diagram showing a process for manufacturing a high pressure discharge lamp according to an embodiment of the present invention.
Figure 4:
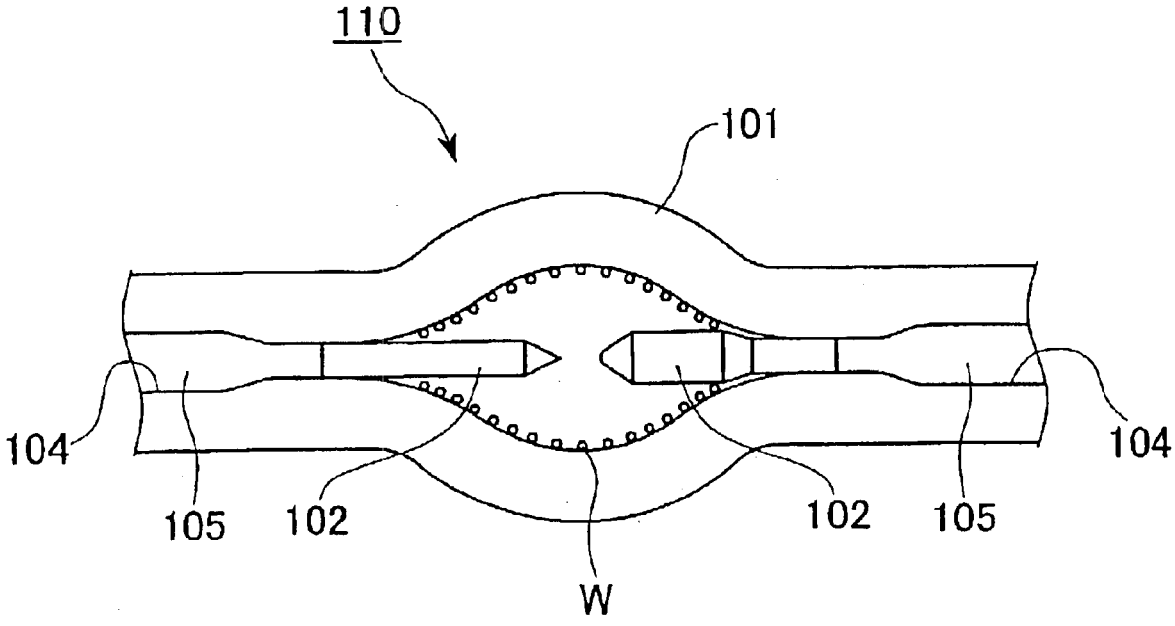
FIG. 4 PRIOR ART
FIG. 4 is a schematic cross-sectional view of a conventional high pressure discharge lamp.

The high pressure discharge lamp 10 was manufactured by using the processes indicated in FIG. 3. That is, Step 1 (bulb formation process): forming the bulb 1 by using a quartz glass pipe;

Step 2 (electrode assembling process): attaching a sleeve of molybdenum foil 5 to the corresponding electrode 2A or 2B made of tungsten containing potassium oxide in the range between about 20 ppm and 40 ppm to form electrode assemblies 6A and 6B;

Step 3 (preliminary annealing process): heating the bulb 1 and the electrode assemblies 6A and 6B to 1,800° C. under a vacuum condition for two hours to perform a preliminary annealing process;

Step 4 (electrode A assembling process): inserting the electrode assembly 6A in the insertion opening 4A of the bulb 1 and carrying out a sealing process of the insertion portion under a vacuum condition by heating the insertion portion to 1,600° C. for 10 minutes;

Step 5 (vacuum process): evacuating the inside of the bulb 1 from the insertion opening 4B to the extent that the degree of vacuum becomes $1\times10^{-2}$ Pa or less so that the partial pressure of oxygen (O) in the bulb 1 is decreased to about $2.5\times10^{-3}$ Pa or less;

Step 6 (mercury introduction process): introducing mercury inside the bulb 1 from the insertion opening 4B in an amount of about 0.15 mg/mm$^3$ or more;

Step 7 (halogen gas introduction process): introducing methylene bromide ($CH_2Br_2$) inside the bulb 1 from the insertion opening 4B in an amount in the range between about $1\times10^{-6}$ $\mu$mol/mm$^3$ and $1\times10^{-8}$ $\mu$mol/mm$^3$;

Step 8 (inert gas introduction process): introducing argon gas inside the bulb 1 from the insertion opening 4B so that the pressure thereof falls in the range between about $6\times10^3$ Pa and $6\times10^4$ Pa; and Step 9 (electrode B assembling process): inserting the electrode assembly 6B in the insertion opening 4B of the bulb 1 and carrying out a sealing process of the insertion portion under a vacuum condition by heating the portion to 1,600° C. for 10 minutes to complete the manufacturing of the high pressure discharge lamp 10.

Note that in the above-mentioned manufacturing process, the order of Step 6 (i.e., the mercury introduction process), Step 7 (i.e., the halogen gas introduction process) and Step 8 (i.e., the inert gas introduction process) may be changed. Also, various changes, for instance, premixing the halogen gas with the inert gas, or introducing the halogen gas and the inert gas inside the bulb 1 at the same time in order to shorten (or omit a part of) the process, may be made to an embodiment according to the present invention.

(Embodiments 1–7)

A high pressure discharge lamp of embodiments 1–7, respectively, according to the present invention was prepared by setting the partial pressure of oxygen (O) in the bulb 1, the partial pressure of halogen gas, and the amount of potassium oxide contained in the electrodes 2A and 2B, respectively, to the values shown in Table 1. In each of the embodiments, the amount of mercury sealed in the bulb 1 was 0.200 mg/mm$^3$ and the amount of argon gas sealed in the bulb 1 was $5\times10^4$ Pa.

COMPARATIVE EXAMPLES 1–6

A high pressure discharge lamp of comparative examples 1–6, respectively, was manufactured by setting at least one of the partial pressure of oxygen (O) in the bulb 1, the partial pressure of halogen gas, and the amount of potassium oxide contained in the electrodes 2A and 2B to the values outside the scope of the present invention. These values are also shown in Table 1. Among the discharge lamps of the comparative examples 1–6, the discharge lamp of the comparative example 1 was constructed based on the values disclosed in Japanese Unexamined Patent Application, First Publication No. 11-149899. This may be considered to be the closest to the scope of the present invention.

TABLE 1

| | Partial pressure of (O) (Pa) | Partial pressure of halogen gas ($\mu$mol/mm$^3$) | Potassium oxide content (ppm) |
|---|---|---|---|
| E.1 | $2.5 \times 10^{-3}$ | $1 \times 10^{-8}$ | 40 |
| E.2 | $2.5 \times 10^{-3}$ | $1 \times 10^{-6}$ | 40 |
| E.3 | $2.5 \times 10^{-3}$ | $1 \times 10^{-6}$ | 20 |
| E.4 | $2.5 \times 10^{-3}$ | $1 \times 10^{-8}$ | 20 |
| E.5 | $2.5 \times 10^{-7}$ | $1 \times 10^{-6}$ | 40 |
| E.6 | $2.5 \times 10^{-7}$ | $1 \times 10^{-6}$ | 20 |
| E.7 | $2.5 \times 10^{-5}$ | $1 \times 10^{-7}$ | 30 |
| Comp. E. 1 | $2.5 \times 10^{-3}$ | $1 \times 10^{-8}$ | *12 |
| Comp. E. 2 | *$2.5 \times 10^{-2}$ | $1 \times 10^{-6}$ | 20 |
| Comp. E. 3 | $2.5 \times 10^{-3}$ | *$1 \times 10^{-1}$ | 20 |
| Comp. E. 4 | *$25 \times 10^{-2}$ | *$1 \times 10^{-5}$ | 30 |
| Comp. E. 5 | $2.5 \times 10^{-5}$ | *$1 \times 10^{-5}$ | *5 |
| Comp. E. 6 | *$2.5 \times 10^{-2}$ | *$1 \times 10^{-5}$ | *5 |

*Indicates that values outside the scope of the present invention.

(Evaluation Tests)

Evaluations of the high pressure discharge lamps of Embodiments 1–7, and of Comparative Examples 1–6 were made by measuring the illuminance maintaining rate (%) and the rate of bulb blowout occurrence (%).

The illuminance maintaining rate (%) of each discharge lamp was measured under the condition of bulb wall loading of 1.5 W/mm$^2$ for 5,000 hours. Note that the initial illuminance of the discharge lamp was regarded as 100%. Results are shown in Table 2.

Also, the rate of bulb blowout occurrence (%) was measured by counting the number of discharge lamps which ruptured during the above-mentioned 5,000 hours of lighting for a certain time period.

TABLE 2

| | Illuminance maintaining rate (%) | | | | | | | |
|---|---|---|---|---|---|---|---|---|
| Time (hr) | 0 | 50 | 100 | 300 | 500 | 1,000 | 2,000 | 5,000 |
| E. 1 | 100 | 90 | 85 | 80 | 75 | 69 | 64 | 61 |
| E. 2 | 100 | 90 | 87 | 82 | 77 | 72 | 68 | 64 |
| E. 3 | 100 | 91 | 86 | 80 | 75 | 70 | 67 | 63 |
| E. 4 | 100 | 90 | 85 | 78 | 73 | 68 | 65 | 61 |
| E. 5 | 100 | 92 | 87 | 83 | 81 | 77 | 73 | 68 |
| E. 6 | 100 | 94 | 91 | 86 | 84 | 80 | 76 | 73 |
| E. 7 | 100 | 92 | 88 | 84 | 82 | 78 | 73 | 68 |
| Comp. E. 1 | 100 | 88 | 80 | 71 | 65 | 58 | 52 | 47 |
| Comp. E. 2 | 100 | 89 | 81 | 73 | 67 | 58 | 50 | 44 |
| Comp. E. 3 | 100 | 89 | 81 | 72 | 67 | 60 | 53 | 48 |
| Comp. E. 4 | 100 | 88 | 80 | 73 | 66 | 57 | 49 | 43 |
| Comp. E. 5 | 100 | 88 | 80 | 70 | 62 | 50 | 45 | 40 |
| Comp. E. 6 | 100 | 87 | 77 | 59 | 50 | 40 | 35 | 30 |

TABLE 3

| | Rate of bulb blowout occurrence (%) | | | | | | | |
|---|---|---|---|---|---|---|---|---|
| Time (hr) | 0 | 50 | 100 | 300 | 500 | 1,000 | 2,000 | 5,000 |
| E. 1 | 0 | 0 | 0 | 0 | 0 | 0 | 0.8 | 1.2 |
| E. 2 | 0 | 0 | 0 | 0 | 0 | 0.5 | 1.5 | 2.0 |
| E. 3 | 0 | 0 | 0 | 0 | 0 | 0.8 | 1.8 | 3.1 |
| E. 4 | 0 | 0 | 0 | 0 | 0 | 0 | 0 | 0.8 |
| E. 5 | 0 | 0 | 0 | 0 | 0 | 0 | 1.2 | 1.9 |
| E. 6 | 0 | 0 | 0 | 0 | 0 | 0 | 0 | 0 |
| E. 7 | 0 | 0 | 0 | 0 | 0 | 0 | 1.0 | 1.5 |
| Comp. E. 1 | 0 | 0 | 0 | 0 | 0.2 | 1.1 | 2.2 | 3.8 |
| Comp. E. 2 | 0 | 0 | 0 | 0 | 0.2 | 1.2 | 2.5 | 4.2 |
| Comp. E. 3 | 0 | 0 | 0.5 | 2.1 | 4.5 | 7.2 | 12.5 | 20.0 |

TABLE 3-continued

| | Rate of bulb blowout occurrence (%) | | | | | | | |
|---|---|---|---|---|---|---|---|---|
| Time (hr) | 0 | 50 | 100 | 300 | 500 | 1,000 | 2,000 | 5,000 |
| Comp. E. 4 | 0 | 0 | 0 | 0.2 | 1.2 | 2.5 | 3.8 | 5.5 |
| Comp. E. 5 | 0 | 0 | 0 | 0 | 0.3 | 1.4 | 2.9 | 4.5 |
| Comp. E. 6 | 0 | 0 | 0 | 0.8 | 1.9 | 3.1 | 7.5 | 14.0 |

As is obvious from the results shown in Tables 2 and 3, the high pressure discharge lamps according to the embodiments 1–7 of the present invention showed excellent and better values as compared with the discharge lamps of the comparative examples 1–6 in which at least one of the partial pressure of oxygen (O), the partial pressure of halogen gas, and the amount of potassium oxide contained in the electrodes was set to be outside the scope of the present invention. The results clearly show that the high pressure discharge lamps according to the embodiments of the present invention have little decrease in the illuminance maintaining rate due to blackening even after being used for a considerably long period of time, and that long-life high pressure discharge lamps, which are capable of preventing leakage of a contained gas or blowout of the bulb, may be obtained in accordance with the present invention.

Having thus described exemplary embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

What is claimed is:

1. A method for manufacturing a high pressure discharge lamp including a quartz glass bulb; a pair of electrodes, each electrode of said pair of electrodes being disposed so as to be opposite the other in said quartz glass bulb and containing potassium oxide in the range between about 20 ppm and 40 ppm; and at least mercury, a halogen gas, and an inert gas contained and sealed in said quartz glass bulb, comprising the steps of:

carrying out an evacuation process in which said quartz glass bulb is evacuated so that the partial pressure of oxygen (O) in said quartz glass bulb becomes about $2.5\times10^{-3}$ Pa or less;

carrying out a mercury sealing process in which said mercury is sealed in said quartz glass bulb so that the amount of said mercury with respect to the space volume in said quartz glass bulb is about 0.15 mg/mm$^3$ or greater;

carrying out a halogen gas introduction process in which said halogen gas is introduced into said quartz glass bulb so that the partial pressure of said halogen gas in said quartz glass bulb falls in the range between about $1\times10^{-6}$ $\mu$mol/mm$^3$ and $1\times10^{-8}$ $\mu$mol/mm$^3$; and carrying out an inert gas introduction process in which said inert gas is introduced into said quartz glass bulb so that the partial pressure of said inert gas in said quartz glass bulb falls in the range between about $6\times10^3$ Pa and $6\times10^4$ Pa.

2. A method for manufacturing a high pressure discharge lamp according to claim 1, wherein said evacuation process is carried out after one of said pair of electrodes is inserted into a first insertion opening formed in said quartz glass bulb and is airtightly sealed with said first insertion opening so that said quartz glass bulb may be evacuated through a second insertion opening formed in said quartz glass bulb;

said halogen gas introduction process is carried out, after said evacuation process, by introducing said halogen gas into said quartz glass bulb through said second insertion opening;

said inert gas introduction process is carried out, after said evacuation process, by introducing said inert gas into said quartz glass bulb through said second insertion opening; and said second insertion opening is airtightly sealed with the other one of said pair of electrodes after carrying out said mercury sealing process, said halogen gas introduction process, and said inert gas introduction process.

3. A method for manufacturing a high pressure discharge lamp according to claim 2, wherein said second insertion opening is airtightly sealed with the other one of said pair of electrodes after carrying out said mercury sealing process, said halogen gas introduction process, and said inert gas introduction process, and said first and second insertion openings are airtightly sealed with said pair of electrodes via a conductive element.

4. A method for manufacturing a high pressure discharge lamp according to claim 3, wherein said conductive element is molybdenum foil.

5. A method for manufacturing a high pressure discharge lamp according to claim 2, further comprising a step of:

preheating said quartz glass bulb and members that form said electrodes to a temperature in the range between about 1,000° C. and 2,000° C. in a vacuum.

6. A method for manufacturing a high pressure discharge lamp according to claim 2, wherein said first insertion opening and one of said pair of electrodes which is to be inserted into said first insertion opening are heated to a temperature in the range between about 1,000° C. and 2,000° C. in a vacuum when said electrode is airtightly sealed with said first insertion opening, and said second insertion opening and the other one of said pair of electrodes which is to be inserted into said second insertion opening are heated to a temperature in the range between about 1,000° C. and 2,000° C. in a vacuum when said other electrode is airtightly sealed with said second insertion opening.

7. A method for manufacturing a high pressure discharge lamp according to claim 1, further comprising the steps of:

carrying out a first electrode assembling process in which one of said pair of electrodes is inserted into a first insertion opening formed in said quartz glass bulb and then said first insertion opening is airtightly sealed; and carrying out a second electrode assembling process in which the other one of said pair of electrodes is inserted into a second insertion opening formed in said quartz glass bulb and then said second insertion opening is airtightly sealed, wherein oxygen present in said quartz glass bulb is evacuated from said second insertion opening in said evacuation process after said first electrode assembling process and before said second electrode assembling process; and said halogen gas is introduced into said quartz glass bulb through said second insertion opening in said halogen gas introduction process after said evacuation process.

8. A method for manufacturing a high pressure discharge lamp according to claim 7, wherein said first insertion opening and one of said pair of electrodes are heated to a temperature in the range between about 1,000° C. and 2,000° C. in a vacuum in said first electrode assembling process, and said second insertion opening and the other one of said pair of electrodes are heated to a temperature in the range between about 1,000° C. and 2,000° C. in a vacuum in said second electrode assembling process.

9. A method for manufacturing a high pressure discharge lamp according to claim 1, further comprising a step of:

preheating said quartz glass bulb and members that form said electrodes to a temperature in the range between about 1,000° C. and 2,000° C. in a vacuum.

10. A method for manufacturing a high pressure discharge lamp including a quartz glass bulb; a pair of electrodes, each electrode of said pair of electrodes being disposed so as to be opposite the other in said quartz glass bulb and containing potassium oxide in the range between about 20 ppm and 40 ppm; and at least mercury, a halogen gas, and an inert gas contained and sealed in said quartz glass bulb, comprising the steps of:

carrying out an evacuation process in which said quartz glass bulb is evacuated so that the partial pressure of oxygen (O) in said quartz glass bulb becomes about $2.5\times10^{-3}$ Pa or less;

carrying out a mercury sealing process in which said mercury is sealed in said quartz glass bulb so that the amount of said mercury with respect to the space volume in said quartz glass bulb becomes about 0.15 $mg/mm^3$ or greater;

carrying out a halogen gas introduction process in which said halogen gas is introduced into said quartz glass bulb so that the partial pressure of said halogen gas in said quartz glass bulb falls in the range between about $1\times10^{-6}$ $\mu mol/mm^3$ and $1\times10^{-8}$ $\mu mol/mm^3$; and carrying out an inert gas introduction process in which said inert gas is introduced into said quartz glass bulb so that the partial pressure of said inert gas in said quartz glass bulb falls in the range between about $6\times10^3$ Pa and $6\times10^4$ Pa, wherein said evacuation process is carried out after one of said pair of electrodes is inserted into a first insertion opening formed in said quartz glass bulb and is airtightly sealed with said first insertion opening so that said quartz glass bulb may be evacuated through a second insertion opening formed in said quartz glass bulb;

said halogen gas introduction process is carried out, after said evacuation process, by introducing said halogen gas into said quartz glass bulb through said second insertion opening; and said inert gas introduction process is carried out, after said evacuation process, by introducing said inert gas into said quartz glass bulb through said second insertion opening.

11. A method for manufacturing a high pressure discharge lamp according to claim 10, wherein said first and second insertion openings are airtightly sealed with said pair of electrodes via a conductive element.

12. A method for manufacturing a high pressure discharge lamp according to claim 11, wherein said conductive element is molybdenum foil.

13. A method for manufacturing a high pressure discharge lamp according to claim 10, further comprising a step of:

preheating said quartz glass bulb and members that form said electrodes to a temperature in the range between about 1,000° C. and 2,000° C. in a vacuum.

* * * * *